US009595216B2

(12) United States Patent
Park et al.

(10) Patent No.: US 9,595,216 B2
(45) Date of Patent: Mar. 14, 2017

(54) DISPLAY APPARATUS AND POWER SUPPLYING METHOD PERFORMED BY DISPLAY APPARATUS IN DIFFERENT POWER MODES

(75) Inventors: Sung-Un Park, Yongin (KR); Wook Lee, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 833 days.

(21) Appl. No.: 13/191,506

(22) Filed: Jul. 27, 2011

(65) Prior Publication Data

US 2012/0044273 A1 Feb. 23, 2012

(30) Foreign Application Priority Data

Aug. 20, 2010 (KR) ..... 10-2010-0080883

(51) Int. Cl.

| | |
|---|---|
| ***G09G 1/00*** | (2006.01) |
| ***G09G 3/20*** | (2006.01) |
| ***G09G 3/32*** | (2016.01) |

(52) U.S. Cl.

CPC ..... *G09G 3/20* (2013.01); *G09G 3/3208* (2013.01); *G09G 2330/02* (2013.01); *G09G 2330/021* (2013.01); *G09G 2330/028* (2013.01)

(58) Field of Classification Search

USPC ..... 345/87–104, 211–213

See application file for complete search history.

(56) References Cited

U.S. PATENT DOCUMENTS

| | | | | |
|---|---|---|---|---|
| 5,663,743 | A | 9/1997 | Fujii et al. | |
| 2001/0030645 | A1* | 10/2001 | Tsutsui et al. | 345/211 |
| 2002/0145599 | A1* | 10/2002 | Endo et al. | 345/211 |
| 2002/0154109 | A1 | 10/2002 | Ikeda | |
| 2005/0017965 | A1* | 1/2005 | Morita et al. | 345/211 |
| 2006/0083033 | A1 | 4/2006 | Myung et al. | |
| 2006/0202913 | A1* | 9/2006 | Hayafuji | 345/44 |
| 2007/0024564 | A1* | 2/2007 | Shimizu | 345/98 |

(Continued)

FOREIGN PATENT DOCUMENTS

| | | |
|---|---|---|
| CN | 1764051 A | 4/2006 |
| EP | 2056282 A2 | 5/2009 |

(Continued)

OTHER PUBLICATIONS

European Search Report in EP 11178192.8-2205, dated Dec. 9, 2011 (Park, et al.).

(Continued)

*Primary Examiner* — Sanghyuk Park

(74) *Attorney, Agent, or Firm* — Lee & Morse, P.C.

(57) ABSTRACT

A display apparatus and a power providing method performed by the display apparatus including a panel that operates in a normal mode or a low power display mode; a power supplying unit that outputs a first high voltage and a first low voltage to the panel in the normal mode, wherein the first high voltage and the first low voltage are first power voltages; and a driving integrated circuit that selectively receives a plurality of input voltages according to a display mode, and that outputs a second high voltage and a second low voltage to the panel in the low power display mode, wherein the second high voltage and the second low voltage are second power voltages.

5 Claims, 7 Drawing Sheets

(56) References Cited

U.S. PATENT DOCUMENTS

| | | | | |
|---|---|---|---|---|
| 2008/0111811 | A1* | 5/2008 | Park | 345/212 |
| 2008/0252577 | A1* | 10/2008 | Goto et al. | 345/87 |
| 2008/0284497 | A1* | 11/2008 | Kim et al. | 327/536 |
| 2009/0027373 | A1* | 1/2009 | Chiang et al. | 345/212 |
| 2009/0109147 | A1 | 4/2009 | Park et al. | |
| 2009/0109158 | A1* | 4/2009 | Shirai | 345/94 |
| 2009/0244110 | A1* | 10/2009 | Ogura | 345/690 |
| 2010/0103150 | A1* | 4/2010 | Huang et al. | 345/205 |

FOREIGN PATENT DOCUMENTS

| | | | |
|---|---|---|---|
| JP | 8-005987 | A | 1/1996 |
| KR | 10-2001-0095149 | A | 11/2001 |
| KR | 10-2008-0093750 | A | 10/2008 |

OTHER PUBLICATIONS

Chinese Office Action dated Dec. 2, 2015 in Corresponging Chinese Patent Application No. 201110166619.6.

* cited by examiner

DISPLAY APPARATUS AND POWER SUPPLYING METHOD PERFORMED BY DISPLAY APPARATUS IN DIFFERENT POWER MODES

BACKGROUND

1. Field

Embodiments relate to a display apparatus that reduces power consumption in a low power display mode, and a power supplying method performed by the display apparatus.

2. Description of the Related Art

A display apparatus displays an image corresponding to an input image by applying a scan signal and a data voltage to each of a plurality of pixels. Each of the pixels operates by receiving at least one power voltage. For this operation, the display apparatus generates at least one power voltage from an external power source. A display panel receives at least one power voltage.

The display apparatus is applied to mobile equipment, such as mobile phones, digital cameras, etc. For mobile equipment, it becomes important to reduce power consumption of the display apparatus. In general, mobile equipment operates by using a battery. It is important to extend a battery use time for mobile equipment by reducing consumption of power stored in the battery. However, the display apparatus in mobile equipment requires high power consumption. There is a demand for decreasing power consumption in the display apparatus.

SUMMARY

Embodiments are therefore directed to a display apparatus and a power supplying method performed thereof, which substantially overcome one or more of the problems due to the limitations and disadvantages of the related art.

It is therefore a feature of an embodiment to provide a display apparatus capable of reducing power consumption.

It is therefore another feature of an embodiment to provide a power supplying method capable of reducing power consumption.

At least one of the above and other features and advantages may be realized by providing a display apparatus including a panel that operates in a normal mode or a low power display mode; a power supplying unit that outputs a first high voltage and a first low voltage to the panel in the normal mode, wherein the first high voltage and the first low voltage are first power voltages; and a driving integrated circuit that selects at least one input voltage from among a plurality of input voltages according to a display mode, and that outputs a second high voltage and a second low voltage to the panel in the low power display mode, wherein the second high voltage and the second low voltage are second power voltages generated based on the selected at least one input voltage.

The power supplying unit may generate the first power voltages based on a panel power voltage, and the driving integrated circuit may generate the second power voltages based on a panel power voltage and a logic voltage.

A difference between the second high voltage and the second low voltage may be less then a difference between the first high voltage and the first low voltage.

The driving integrated circuit may include a mode determination unit that determines the display mode; and a voltage conversion unit that generates a first driving voltage and a second driving voltage based on the panel power voltage in the normal mode, and that generates the second power voltages, a third driving voltage, and a fourth driving voltage based on the panel power voltage and the logic voltage in the low power display mode.

The voltage conversion unit may include a charge pump that boosts an input voltage and then outputs a positive voltage and a negative voltage that are a multiple of the input voltage; and an amplifier that amplifies the positive voltage and the negative voltage output from the charge pump, and then generates the first driving voltage, the second driving voltage, the second power voltages, the third driving voltage, and the fourth driving voltage.

The charge pump may include a first booster that outputs a positive first output voltage boosted to a predetermined level by using panel power voltages input via a first input line and a second input line in the normal mode, and that outputs a positive first output voltage boosted to a predetermined level by using the panel power voltage input via the first input line, and a logic voltage input via the second input line in the low power display mode; a second booster that outputs a positive second output voltage boosted to a predetermined level by using the positive first output voltages input via a first input line and a second input line in the normal mode, and that outputs a positive second output voltage boosted to a predetermined level by using the panel power voltage input via the first input line, and a logic voltage input via the second input line in the low power display mode; and a third booster that outputs a negative third output voltage stepped down to a predetermined level by using the positive first output voltages input via a first input line and a second input line in the normal mode, and that outputs a negative third output voltage stepped down to a predetermined level by using the panel power voltage input via the first input line in the low power display mode.

The driving integrated circuit may further include a gamma correction unit that receives a voltage as a gamma correction voltage, wherein the voltage is obtained by amplifying the first output voltage.

The display apparatus may further include a touch integrated circuit that receives a touch voltage and then generates a driving signal for operating a touch sensor, and the driving integrated circuit may generate the second power voltages based on the touch voltage.

The driving integrated circuit may include a mode determination unit that determines the display mode; and a voltage conversion unit that generates a first driving voltage and a second driving voltage based on the panel power voltage in the normal mode, and that generates the second power voltages, a third driving voltage, and a fourth driving voltage based on the touch voltage in the low power display mode.

The charge pump may include a first booster that outputs a positive first output voltage boosted to a predetermined level by using panel power voltages input via a first input line and a second input line in the normal mode, and that outputs a positive first output voltage boosted to a predetermined level by using touch voltages input via the first input line and the second input line in the low power display mode; a second booster that outputs a positive second output voltage boosted to a predetermined level by using the positive first output voltages input via a first input line and a second input line in the normal mode, and that outputs a positive second output voltage boosted to a predetermined level by using the positive first output voltages input via the first input line and the second input line in the low power display mode; and a third booster that outputs a negative third output voltage stepped down to a predetermined level by using the positive first output voltages input via a first input line and a second input line in the normal mode, and that outputs a negative third output voltage stepped down to a predetermined level by using a touch voltage input via the first input line in the low power display mode.

The display apparatus may further include a first switching device that is arranged between the power supplying unit and the panel, and that cuts the first high voltage; and a second switching device that is arranged between the power supplying unit and the panel, and that cuts the first low voltage.

At least one of the above and other features and advantages may also be realized by providing a power supplying method performed by a display apparatus so as to drive a panel that operates in a normal mode and a low power display mode, the power supplying method including the operations of, supplying a first high voltage and a first low voltage by a power supplying unit in the normal mode, the first high voltage and the first low voltage are first power voltages to the panel; and selecting at least one input voltage from among a plurality of input voltages by a driving integrated circuit in the low power display mode, and outputting a second high voltage and a second low voltage to the panel, wherein the second high voltage and the second low voltage are second power voltages generated based on the selected at least one input voltage.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
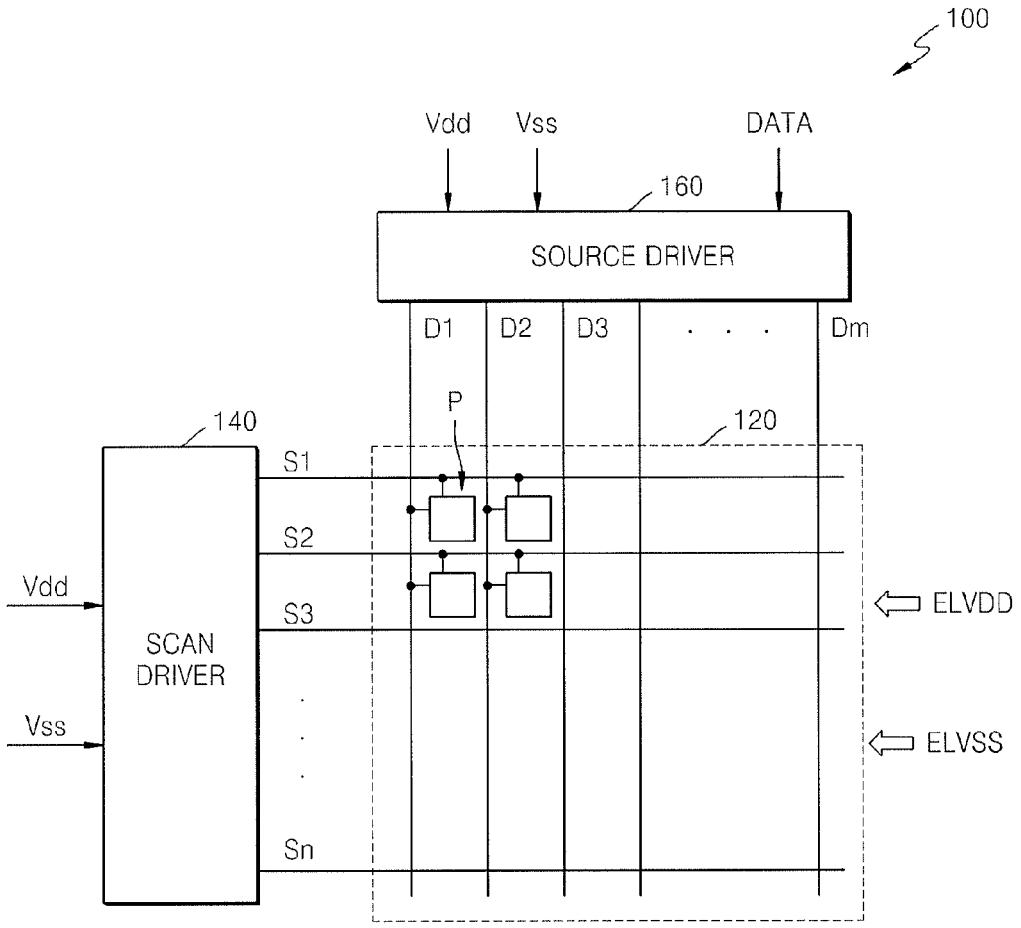
FIG. 1 illustrates a diagram of a configuration of an organic light-emitting panel according to an embodiment.

Korean Patent Application No. 10-2010-0080883, filed on Aug. 20, 2010, in the Korean Intellectual Property Office, and entitled: "Display Apparatus and Power Supplying Method Performed By Display Apparatus," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. Like reference numerals in the drawings denote like elements. In the following description, well-known functions or constructions are not described in detail, as they would obscure the embodiments with unnecessary detail.

FIG. 1 illustrates a diagram of a configuration of an organic light-emitting panel 100 according to an embodiment. Referring to FIG. 1, the organic light-emitting panel 100 includes a display unit 120, a scan driver 140, and a source driver 160.

The display unit 120 includes a plurality of scan lines S1-Sn, a plurality of data lines D1-Dm, and a plurality of pixels P. The scan lines S1-Sn are arrayed in rows at regular intervals, and deliver scan signals, respectively. The data lines D1-Dm are arrayed in columns at regular intervals, and deliver data signals, respectively. The scan lines S1-Sn, and the data lines D1-Dm are matrix-arrayed, and a pixel P is formed in each of intersections between the scan lines S1-Sn, and the data lines D1-Dm.

The display unit 120 operates according to a normal mode, a low power display mode, and a standby mode of a display apparatus including the organic light-emitting panel 100. The display unit 120 receives a power voltage ELVDD and ELVSS, and then allows light-emission of a light-emitting device. In the normal mode, the display unit 120 receives a first high voltage ELVDD1 and a first low voltage ELVSS1 which are first power voltages, and supplies them to each pixel P. In the low power display mode, the display unit 120 receives a second high voltage ELVDD2 and a second low voltage ELVSS2 which are second power voltages, and supplies them to each pixel P. In each pixel P, a driving current flows via the light-emitting device from the first high voltage ELVDD1 to the first low voltage ELVSS1, or from the second high voltage ELVDD2 to the second low voltage ELVSS2. The driving current allows the light-emission of the light-emitting device, in correspondence to a data signal applied to each pixel P.

In order to realize a color display, each pixel P may be dedicated to display one of primary colors, or each pixel P may alternately display primary colors according to time. A desired color is displayed by spatial or temporal summation of the primary colors. Examples of the primary colors include red (R), green (G), and blue (B) colors. Where a color is displayed by the temporal summation, red (R), green (G), and blue (B) colors are alternately displayed in one pixel according to time, so that the color is realized. Where a color is displayed by the spatial summation, the color is realized by three pixels of R, G, and B pixels. Thus, each of the three pixels is referred to as a sub-pixel, and the three sub-pixels are referred to as one pixel. Where a color is displayed by the spatial summation, R, G, and B pixels may be alternately arrayed in a row direction or a column direction, or may be arrayed in positions that correspond to three vertexes of a triangle.

The scan driver 140 operates by receiving a first driving voltage Vdd and a second driving voltage Vss in the normal mode, and by receiving a third driving voltage Vdd' and a fourth driving voltage Vss' in the low power display mode. The scan driver 140 is connected to the scan lines S1-Sn of the display unit 120. The scan driver 140 applies a scan signal, which is configured as a combination of a gate-on voltage and a gate-off voltage, to the scan lines S1-Sn. The scan driver 140 may sequentially apply the scan signal to the scan lines S1-Sn. Where the scan signal has the gate-on voltage, a switching transistor connected to a corresponding scan line is turned on. The corresponding scan line is among the scan lines S1-Sn.

The source driver 160 operates by receiving a first driving voltage Vdd and a second driving voltage Vss in the normal mode, and by receiving a third driving voltage Vdd' and a fourth driving voltage Vss' in the low power display mode. The source driver 160 is connected to the data lines D1-Dm of the display unit 120, and applies a data signal indicating a gray scale to the data lines D1-Dm. The source driver 160 converts input image data DATA having an input gray scale into a data signal in the form of voltage or current.

The scan driver 140 and the source driver 160 is in at least one integrated circuit chip, and may be directly mounted on the display unit 120. In another embodiment, the scan driver 140, the source driver 160, the signal lines S1-Sn and D1-Dm, and a thin film transistor (TFT) may be integrated to the display unit 120. The scan driver 140 and the source driver 160 may be integrated into one chip.

Figure 2:
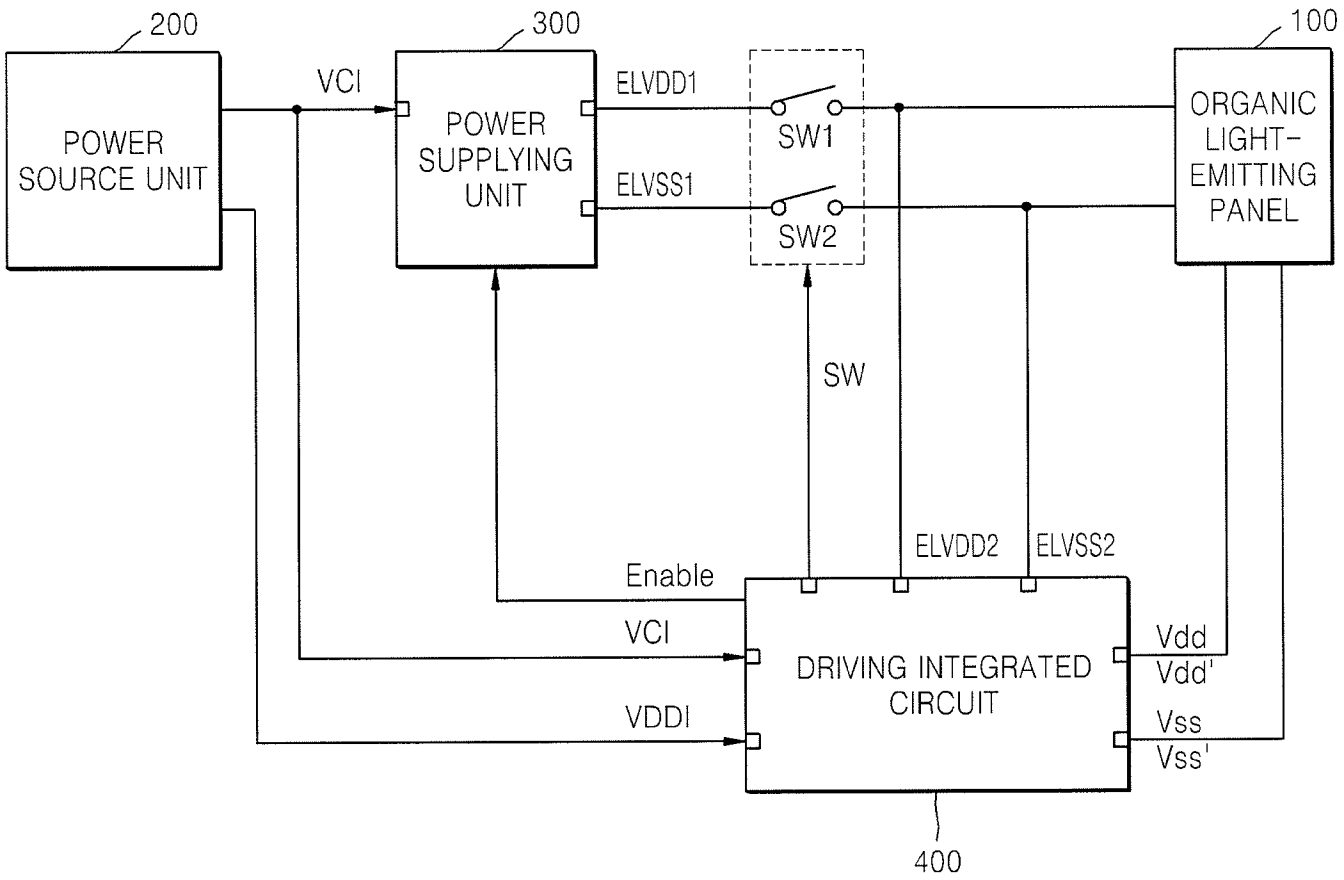
FIG. 2 illustrates a block diagram of an organic light-emitting display apparatus according to an embodiment.

FIG. 2 illustrates a block diagram of an organic light-emitting display apparatus according to another embodiment. Referring to FIG. 2, the organic light-emitting display apparatus includes the organic light-emitting panel 100, a power source unit 200, a power supplying unit 300, and a driving integrated circuit 400.

The organic light-emitting display apparatus may operate in numerous operation modes, including a normal mode, a low power display mode, and a standby mode.

The normal mode indicates a general image display mode in which most functions of the organic light-emitting display apparatus are active.

The low power display mode indicates a power saving mode that reduces the brightness of the organic light-emitting panel 100, or operates only some pixel regions of the organic light-emitting panel 100 to reduce power consumption. For example, where the organic light-emitting display apparatus does not receive a user input during a predetermined time period, the organic light-emitting display apparatus may operate in the low power display mode to reduce power consumption. In another example, where the organic light-emitting display apparatus operates by using a battery and the remaining capacity of the battery is equal to or less than a predetermined level, the organic light-emitting display apparatus may operate in the low power display mode so as to extend available operation time of the organic light-emitting display apparatus. Only some pixel regions may be active in the low power display mode so as to provide functions of a watch, a calendar, a to-do list, etc.

The standby mode indicates the operation mode in which a power of the organic light-emitting display apparatus remains turned-on, while the organic light-emitting panel 100 does not emit light. For example, in a case where the organic light-emitting display apparatus does not receive a user input during a predetermined time period and the organic light-emitting display apparatus operates in the low power display mode, the organic light-emitting display apparatus may enter the standby mode. In another example, if the organic-light emitting display apparatus does not receive a user input during a predetermined time period and the remaining capacity of a battery is equal to or less than a predetermined level, the organic light-emitting display apparatus may be switched from the normal mode to the standby mode.

In the normal mode, the organic light-emitting panel 100 receives a first high voltage ELVDD1 and a first low voltage ELVSS1 from the power supplying unit 300, and supplies them to each pixel P. In the low power display mode, the organic light-emitting panel 100 receives a second high voltage ELVDD2 and a second low voltage ELVSS2 from the driving integrated circuit 400, and supplies them to each pixel P. In the normal mode, the organic light-emitting panel 100 receives a first driving voltage Vdd and a second driving voltage Vss from the driving integrated circuit 400 so as to operate a driver (not shown). In the low power display mode, the organic light-emitting panel 100 receives a third driving voltage Vdd' and a fourth driving voltage Vss' from the driving integrated circuit 400. A configuration of the organic light-emitting panel 100 is described above with reference to FIG. 1.

The power source unit 200 may receive a power from an external power source, and may supply the power to each unit in the organic light-emitting panel 100. The power source unit 200 may also supply a power that is charged in a battery to each unit in the organic light-emitting panel 100. The power source unit 200 generates an initial voltage required to operate the organic light-emitting display apparatus by using a voltage output from the external power source or from the battery. The initial voltage may include a panel power voltage VCI and a logic voltage VDDI. The power source unit 200 outputs the panel power voltage VCI to the power supplying unit 300 and the driving integrated circuit 400. The power source unit 200 outputs the logic voltage VDDI to the driving integrated circuit 400. The logic voltage VDDI is used to drive a logic circuit in the driving integrated circuit 400.

The power supplying unit 300 receives the panel power voltage VCI from the power source unit 200, converts the panel power voltage VCI, and generates the first high voltage ELVDD1 and the first low voltage ELVSS1. The first high voltage ELVDD1 and the first low voltage ELVSS1 allows light-emission of a light-emitting device of the organic light-emitting panel 100. The panel power voltage VCI may be regulated and used as an input voltage. The panel power voltage VCI may be regulated for generating the first high voltage ELVDD1 and the first low voltage ELVSS1. The first high voltage ELVDD1 has a positive level, and the first low voltage ELVSS1 has a negative level. The power supplying unit 300 may be electrically connected to the organic light-emitting panel 100 via switching devices SW1 and SW2. The first high voltage ELVDD1 and the first low voltage ELVSS1 are input to the organic light-emitting panel 100. The power supplying unit 300 may use a direct current DC-to-DC converter as a DC power generator.

When the organic light-emitting panel 100 operates in the normal mode, the power supplying unit 300 supplies the first high voltage ELVDD1 and the first low voltage ELVSS1 to the organic light-emitting panel 100. When the organic light-emitting panel 100 operates in the low power display mode or the standby mode, the power supplying unit 300 cuts the first high voltage ELVDD1 and the first low voltage ELVSS1. The first high voltage ELV and the first low voltage ELVSS1 are supplied to the organic light-emitting panel 100.

The power supplying unit 300 uses a low voltage including the panel power voltage VCI as an initial input power. In order to generate a voltage for allowing the light-emission of the light-emitting device, it is necessary to convert the initial input power by boosting or stepping down the initial input power to a desired voltage. A structure capable of simultaneously generating the first high voltage ELVDD1 and the first low voltage ELVSS1, with a large voltage difference therebetween, is formed of a plurality of devices. Thus, the structure formed of a plurality of devices increases power consumption. When the organic light-emitting panel 100 operates in the low power display mode, the power supplying unit 300 requires a large quiescent current. The power consumed by the quiescent current is greater than power applied to the organic light-emitting panel 100. In order to prevent the quiescent current consumed when the organic light-emitting panel 100 operates in the low power display mode, the power supplying unit 300 supplies the first high voltage ELVDD1 and the first low voltage ELVSS1 to the organic light-emitting panel 100 only when the organic light-emitting panel 100 operates in the normal mode.

The driving integrated circuit 400 selects a plurality of input voltages according to a display mode of the organic light-emitting panel 100, and generates a voltage from combination of the selected input voltages. The voltage is necessary for the organic light-emitting panel 100 in the normal mode or the low power display mode. For example, the driving integrated circuit 400 may receive the panel power voltage VCI and the logic voltage VDDI from the power source unit 200, and may generate a voltage from the appropriate combination thereof. The voltage generated is supplied to the organic light-emitting panel 100. The driving integrated circuit 400 determines the display mode of the organic light-emitting panel 100. The driving integrated circuit 400 outputs a control signal SW that turns on the switching devices SW1 and SW2 when the organic light-emitting panel 100 is in the normal mode. The driving integrated circuit outputs a control signal SW that turns off the switching devices SW1 and SW2 when the organic light-emitting panel 100 is in the low power display mode or the standby mode.

When the organic light-emitting panel 100 is in the normal mode, the driving integrated circuit 400 receives the panel power voltage VCI, and generates a first driving voltage Vdd and a second driving voltage Vss for operating each driver of the organic light-emitting panel 100. The first driving voltage Vdd and the second driving voltage Vss are supplied to the organic light-emitting panel 100.

When the organic light-emitting panel 100 is in the low power display mode, the driving integrated circuit 400 generates the second high voltage ELVDD2 and the second low voltage ELVSS2 by using the panel power voltage VCI and the logic voltage VDDI. The second high voltage ELVDD2 has a positive level, and the second low voltage ELVSS2 has a negative level. A voltage difference between the second high voltage ELVDD2 and the second low voltage ELVSS2 is less then the voltage difference between the first high voltage ELVDD1 and the first low voltage ELVSS1. The second high voltage ELVDD2 and the second low voltage ELVSS2 are supplied to the organic light-emitting panel 100. The second high voltage ELVDD2 and the second low voltage ELVSS2 may be generated by a combination of the panel power voltage VCI and the logic voltage VDDI. The second high voltage ELVDD2 and the second low voltage ELVSS2 may be generated by using a charge pump in the driving integrated circuit 400. Also, the driving integrated circuit 400 generates a third driving voltage Vdd' and a fourth driving voltage Vss' by using the panel power voltage VCI and the logic voltage VDDI. The third driving voltage Vdd and the fourth driving voltage Vss' may be equivalent to or different from the first driving voltage Vdd and the second driving voltage Vss.

As described above, when the low voltage such as the panel power voltage VCI is boosted or stepped down so as to generate the voltage necessary for the organic light-emitting panel 100, power consumption increases. However, in the present embodiment, the driving integrated circuit 400 does not boost or step down only the panel power voltage VCI, but uses both of the panel power voltage VCI and the logic voltage VDDI. Thus, boosting or stepping down may be decreased or not needed at all. Therefore, for the organic light-emitting panel 100 in the low power display mode, it is possible to generate the optimal low voltage by using a minimum power.

In the low power display mode, it is possible to decrease power consumed by the driving integrated circuit 400, when the driving integrated circuit 400 generates the second high voltage ELVDD2 and the second low voltage ELVSS2.

Figure 3:
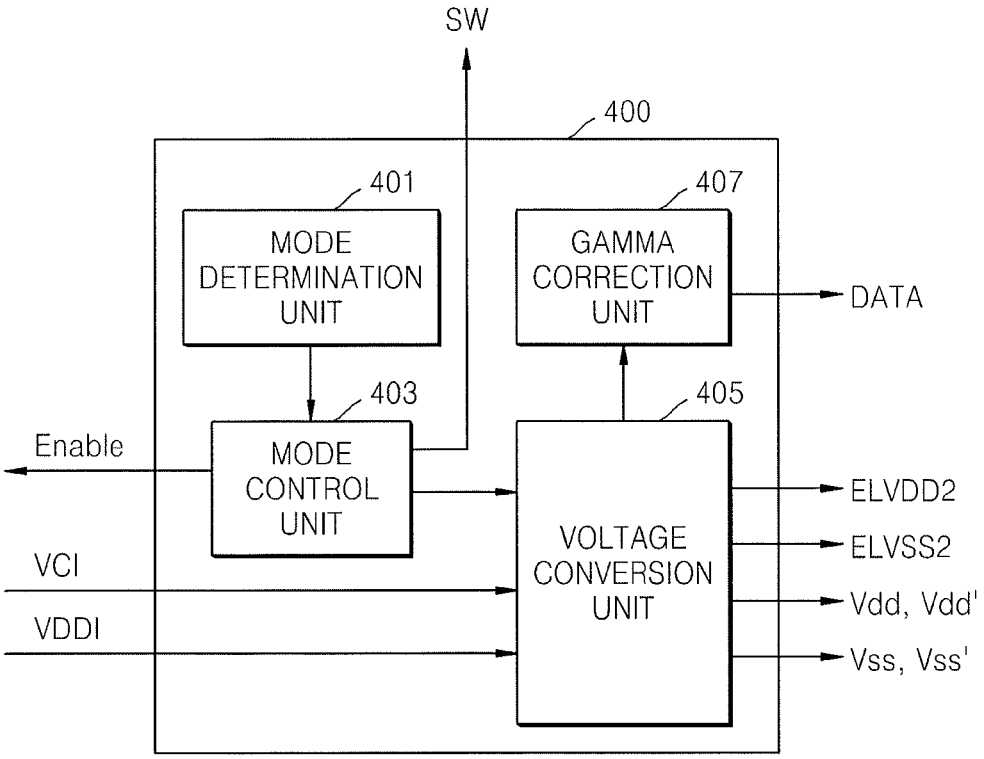
FIG. 3 illustrates a block diagram of a configuration of a driving integrated circuit of FIG. 2 according to an embodiment.

FIG. 3 illustrates a block diagram of a configuration in the driving integrated circuit 400 of FIG. 2 according to an embodiment. Referring to FIG. 3, the driving integrated circuit 400 includes a mode determination unit 401, a mode control unit 403, a voltage conversion unit 405, and a gamma correction unit 407.

The mode determination unit 401 determines a display mode of the organic light-emitting panel 100. The mode determination unit 401 compares a display mode of the organic light-emitting panel 100 at a previous frame with a display mode of the organic light-emitting panel 100 at a current frame. When the display modes are the same, the power supplying unit 300 and the driving integrated circuit 400 operate in the same manner as the previous frame.

The mode control unit 403 controls operations of the power supplying unit 300 (refer to FIG. 2), the first and second switching devices SW1 and SW2 (refer to FIG. 2), and the voltage conversion unit 405 according to the mode determination unit 401. The mode control unit 403 controls the operation of the power supplying unit 300 by applying an enable signal to the power supplying unit 300. The mode control unit 403 controls the operations of the first and second switching devices SW1 and SW2 by applying a switching signal SW to each of the first and second switching devices SW1 and SW2.

The voltage conversion unit 405 selects a plurality of input voltages according to the display mode, generates a plurality of output voltages by boosting or stepping down the selected voltages or by combination of the selected voltages, and outputs the generated output voltages to the gamma correction unit 407 and the organic light-emitting panel 100.

When the organic light-emitting panel 100 operates in the normal mode, the voltage conversion unit 405 generates a first driving voltage Vdd and a second driving voltage Vss by boosting and stepping down a panel power voltage VCI. The voltage conversion unit 405 supplies the first driving voltage Vdd and the second driving voltage Vss to the organic light-emitting panel 100. When the organic light-emitting panel 100 operates in the low power display mode, the voltage conversion unit 405 generates a second high voltage ELVDD2 and a second low voltage ELVSS2, and a third driving voltage Vdd' and a fourth driving voltage Vss' by combining the panel power voltage VCI and a logic voltage VDDI. The voltage conversion unit 405 supplies the second high voltage ELVDD2, a second low voltage ELVSS2, a third driving voltage Vdd', and a fourth driving voltage Vss' to the organic light-emitting panel 100.

The gamma correction unit 407 receives a gamma correction voltage generated by the voltage conversion unit 405, and outputs data DATA. The output data DATA has a corrected gamma value. The gamma correction unit 407 outputs data DATA to the organic light-emitting panel 100.

Although not illustrated in FIG. 3, the driving integrated circuit 400 may include a timing control unit (not shown). The timing control unit outputs a control signal for controlling each driver of the organic light-emitting panel 100. For example, the timing control unit generates a scan control signal and a data control signal. The timing control unit applies the scan control signal and the data control signal to a scan driver and a source driver, respectively, of the organic light-emitting panel 100. The scan control signal includes a scan start signal and a plurality of clock signals SCLK. The scan start signal indicates a start of a scanning operation. The data control signal includes a horizontal synchronization start signal STH and a clock signal. The horizontal synchronization start signal STH indicates a transfer of input image data with respect to pixels P in one row.

Figure 4:
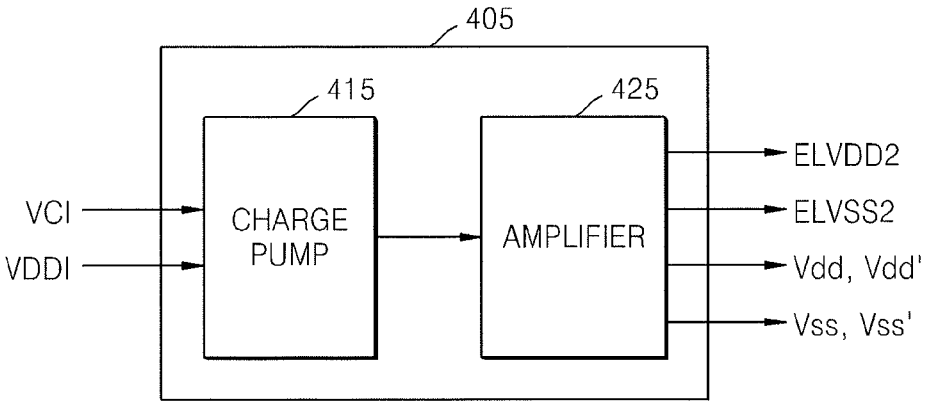
FIG. 4 illustrates a block diagram of a configuration of a voltage conversion unit of FIG. 3 according to an embodiment.

FIG. 4 illustrates a block diagram of a configuration in the voltage conversion unit 405 of FIG. 3 according to an embodiment. Referring to FIG. 4, the voltage conversion unit 405 includes a charge pump 415 and an amplifier 425.

The charge pump 415 boosts an input voltage and then outputs a positive voltage and a negative voltage, which are a multiple of the input voltage. The charge pump 415 uses capacitors in the boosting operation. The input voltage of the charge pump 415 includes a panel power voltage VCI and a logic voltage VDDI.

The amplifier 425 amplifies a voltage output from the charge pump 415, and then generates a first driving voltage Vdd and a second driving voltage Vss and Vdd' and Vss'. The amplifier 425 amplifies a voltage output from the charge pump 415, and then generates a second high voltage ELVDD2 or a second low voltage ELVSS2. The amplifier 425 may separately include an amplifier for generation of a driving voltage, and an amplifier for generation of a power voltage.

Figure 5:
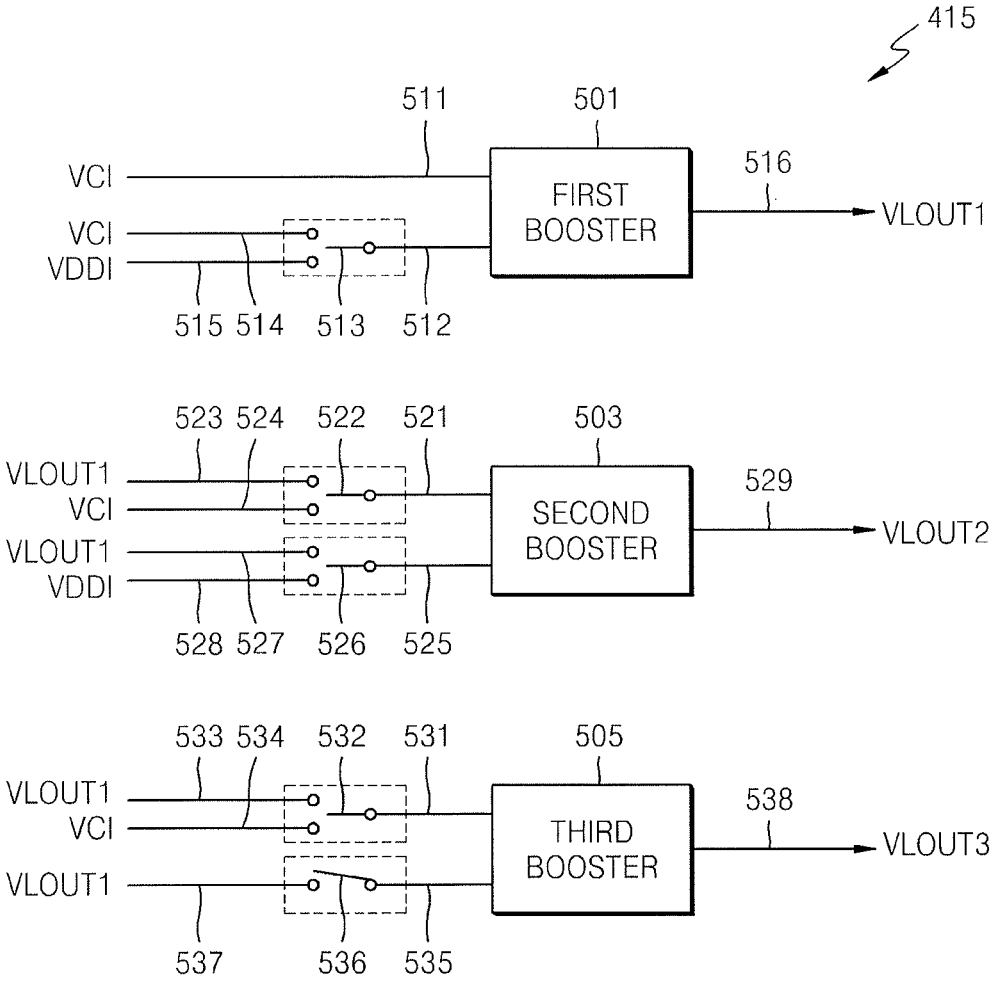
FIG. 5 illustrates a block diagram of a configuration of a charge pump of FIG. 4 according to an embodiment.

FIG. 5 illustrates a block diagram of a configuration in the charge pump 415 of FIG. 4 according to an embodiment. Referring to FIG. 5, the charge pump 415 includes a first booster 501, a second booster 503, and a third booster 505. Each of the boosters 501, 503, and 505 selectively receives an input voltage according to a display mode of the organic light-emitting panel 100, and outputs a voltage according to the display mode. The input voltage of each of the boosters 501, 503, and 505 includes a panel power voltage VCI and a logic voltage VDDI.

The first booster 501 outputs a first output voltage VLOUT1 by using the panel power voltage VCI and the logic voltage VDDI. The first booster 501 receives the panel power voltage VCI via a first booster input line 511. The first booster 501 receives the panel power voltage VCI or the logic voltage VDDI via a second booster input line 512. A switch 513 that is connected to the second booster input line 512 is selectively connected to a panel power voltage input line 514 or a logic voltage input line 515 according to a display mode of the organic light-emitting panel 100.

When the organic light-emitting panel 100 is in the normal mode, the switch 513 is connected to the panel power voltage input line 514. The first booster 501 outputs a first output voltage VLOUT1 via a first output line 516 by using the panel power voltage VCI applied via the first booster input line 511 and the panel power voltage VCI applied via the second booster input line 512. The first output voltage VLOUT1 corresponds to 2×VCI, i.e. a double of the panel power voltage VCI. The first output voltage VLOUT1 is amplified by the amplifier 425, and output to the gamma correction unit 407.

When the organic light-emitting panel 100 is in the low power display mode, the switch 513 is connected to the logic voltage input line 515. The first booster 501 outputs a first output voltage VLOUT1 via the first output line 516 by using the panel power voltage VCI. The panel power voltage VCI is applied via the first booster input line 511 and the logic voltage VDDI is applied via the second booster input line 512. The first output voltage VLOUT1 corresponds to VCI+VDDI, i.e. the sum of the panel power voltage VCI and the logic voltage VDDI. The first output voltage VLOUT1 is amplified by the amplifier 425, and is output to the gamma correction unit 407.

The second booster 503 outputs a second output voltage VLOUT2 by using the first output voltage VLOUT1, the panel power voltage VCI, and the logic voltage VDDI. The second booster 503 receives the first output voltage VLOUT1 or the panel power voltage VCI via a first booster input line 521. A switch 522 that is connected to the first booster input line 521 is selectively connected to a first output voltage input line 523 or a panel power voltage input line 524 according to a display mode of the organic light-emitting panel 100. The second booster 503 receives the first output voltage VLOUT1 or the logic voltage VDDI via a second booster input line 525. A switch 526 is connected to the second booster input line 525. The switch 526 is selectively connected to a first output voltage input line 527 or a logic voltage input line 528 according to a display mode of the organic light-emitting panel 100.

When the organic light-emitting panel 100 is in the normal mode, the switch 522 is connected to the first output voltage input line 523, and the switch 526 is connected to the first output voltage input line 527. The second booster 503 outputs a second output voltage VLOUT2 via a second output line 529 by using the first output voltage VLOUT1 (2×VCI). The first output voltage VLOUT1 is applied via the first booster input line 521 and the second booster input line 525. The second output voltage VLOUT2 corresponds to 4×VCI, i.e. a quadruple of the panel power voltage VCI. The second output voltage VLOUT2 is amplified by the amplifier 425, and output as a first driving voltage Vdd.

When the organic light-emitting panel 100 is in the low power display mode, the switch 522 is connected to the panel power voltage input line 524, and the switch 526 is connected to the logic voltage input line 528. The second booster 503 outputs a second output voltage VLOUT2 via the second output line 529 by using the panel power voltage VCI applied via the first booster input line 521 and the logic voltage VDDI applied via the second booster input line 525, wherein the second output voltage VLOUT2 corresponds to VCI+VDDI that is the sum of the panel power voltage VCI and the logic voltage VDDI. The second output voltage VLOUT2 is amplified by the amplifier 425, and then is output as a second high voltage ELVDD2 or a third driving voltage Vdd'.

The third booster 505 outputs a third output voltage VLOUT3 by using the first output voltage VLOUT1 and the panel power voltage VCI. The third booster 505 receives the first output voltage VLOUT1 or the panel power voltage VCI via a first booster input line 531. A switch 532, connected to the first booster input line 531, is selectively connected to a first output voltage input line 533 or a panel power voltage input line 534 according to a display mode of the organic light-emitting panel 100. The third booster 505 receives the first output voltage VLOUT1 via a second booster input line 535. A switch 536, connected to the second booster input line 535, is selectively connected to a first output voltage input line 537 according to a display mode of the organic light-emitting panel 100.

When the organic light-emitting panel 100 is in the normal mode, the switch 532 is connected to the first output voltage input line 533, and the switch 536 is connected to the first output voltage input line 537. The third booster 505 outputs a third output voltage VLOUT3 via a third output line 538 by using the first output voltage VLOUT1 (2×VCI). The first output voltage VLOUT1 is applied via the first booster input line 531 and the second booster input line 535. The third output voltage VLOUT3 corresponds to −4×VCI, i.e. a negative quadruple of the panel power voltage VCI. The third output voltage VLOUT3 is amplified by the amplifier 425, and output as a second driving voltage Vss.

When the organic light-emitting panel 100 is in the low power display mode, the switch 532 is connected to the panel power voltage input line 534, and the switch 536 is open. The third booster 505 outputs a third output voltage VLOUT3 via the third output line 538 by using the panel power voltage VCI. The panel power voltage VCI is applied via the first booster input line 531. The third output voltage VLOUT3 corresponds to −1×VCI, i.e. a negative of the panel power voltage VCI. The third output voltage VLOUT3 is amplified by the amplifier 425, and output as a second low voltage ELVSS2 or a fourth driving voltage Vss'.

Figure 6:
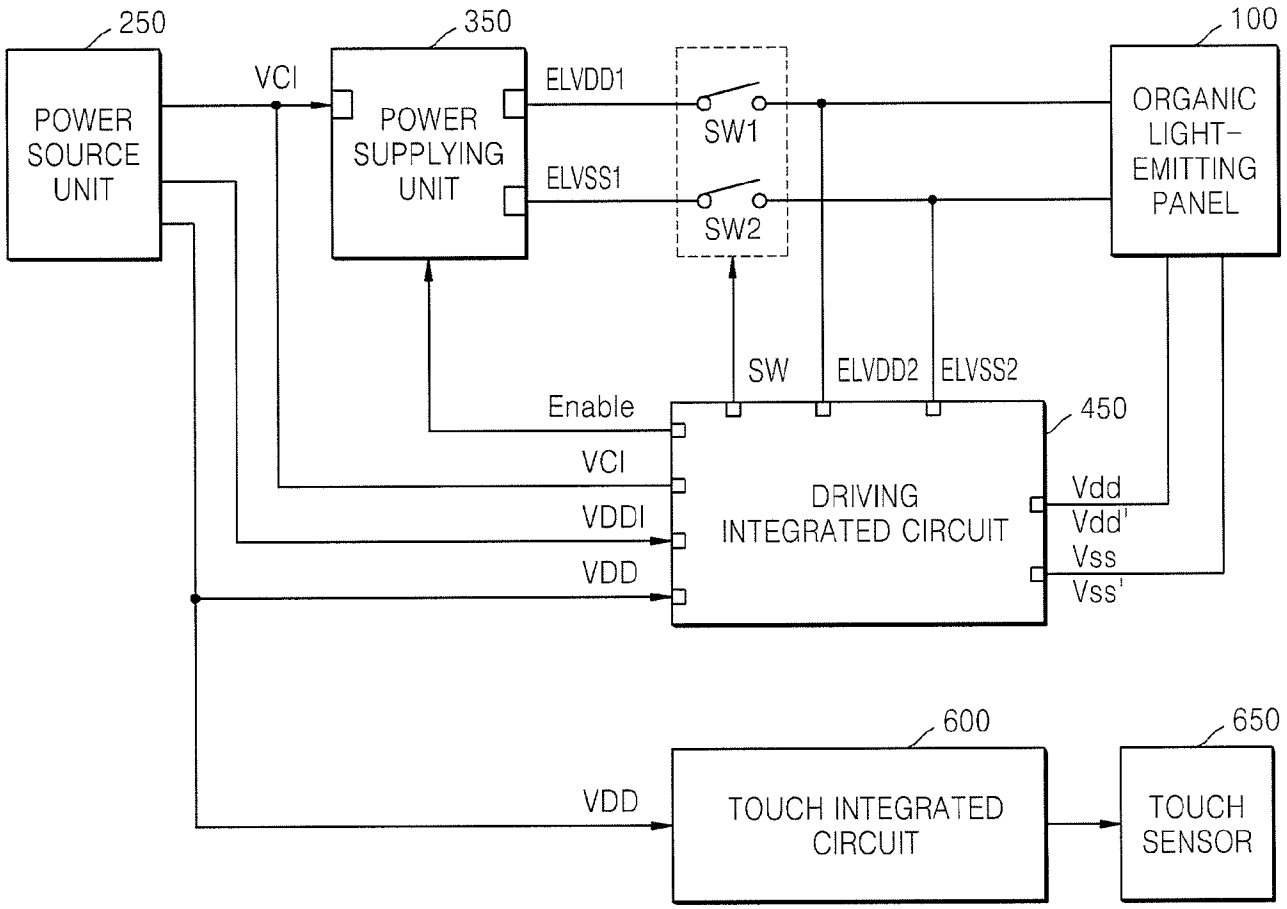
FIG. 6 illustrates a block diagram of an organic light-emitting display apparatus according to another embodiment.

FIG. 6 illustrates a block diagram of an organic light-emitting display apparatus according to another embodiment. Referring to FIG. 6, the organic light-emitting display apparatus includes the organic light-emitting panel 100, a power source unit 250, a power supplying unit 350, a driving integrated circuit 450, a touch integrated circuit 600, and a touch sensor 650. The embodiment of FIG. 6 is different from the embodiment of FIG. 2 in that the embodiment of FIG. 6 further includes the touch integrated circuit 600 and the touch sensor 650. The embodiment of FIG. 6 uses a touch voltage VDD as an input voltage for generating a power voltage of the driving integrated circuit 450, instead of using a logic voltage VDDI in the embodiment of FIG. 2.

When the organic light-emitting panel 100 operates in a normal mode, the organic light-emitting panel 100 receives a first high voltage ELVDD1 and a first low voltage ELVSS1 from the power supplying unit 350. The organic light-emitting panel 100 supplies the first high voltage ELVDD1 and a first low voltage ELVSS1 to each pixel. When the organic light-emitting panel 100 operates in a low power display mode, the organic light-emitting panel 100 receives a second high voltage ELVDD2 and a second low voltage ELVSS2 from the driving integrated circuit 450. The organic light-emitting panel 100 supplies the second high voltage ELVDD2 and the second low voltage ELVSS2 to each pixel. The organic light-emitting panel 100 receives a first driving voltage Vdd and a second driving voltage Vss for operating each driver from the driving integrated circuit 450. When the organic light-emitting panel 100 operates in the low power display mode, the organic light-emitting panel 100 receives a third driving voltage Vdd' and a fourth driving voltage Vss' from the driving integrated circuit 450. The configuration in the organic light-emitting panel 100 is described above with reference to FIG. 1.

The power source unit 250 may receive power from an external power source, and may supply the power to each unit in the organic light-emitting panel 100. The power source unit 250 may supply a power that is charged in a battery to each unit in the organic light-emitting panel 100. The power source unit 250 generates an initial voltage required to operate the organic light-emitting display apparatus by using a voltage output from the external power source or from the battery. The initial voltage may include a panel power voltage VCI, a logic voltage VDDI, and a touch voltage VDD. The power source unit 250 outputs the panel power voltage VCI to the power supplying unit 350 and the driving integrated circuit 450, and outputs the logic voltage VDDI to the driving integrated circuit 450. The logic voltage VDDI is used to drive a logic circuit in the driving integrated circuit 450. The power source unit 250 outputs the touch voltage VDD to the driving integrated circuit 450 and the touch integrated circuit 600. The touch voltage VDD is used to drive the touch integrated circuit 600.

The power supplying unit 350 receives the panel power voltage VCI from the power source unit 250, converts the panel power voltage VCI, and then generates the first high voltage ELVDD1 and the first low voltage ELVSS1. The generation of the first high voltage ELVDD1 and the first low voltage ELVSS1 allows for light-emission of a light-emitting device of the organic light-emitting panel 100. The panel power voltage VCI may be regulated. The power voltage VCI may be used as an input voltage for generating the first high voltage ELVDD1 and the first low voltage ELVSS1. The first high voltage ELVDD1 has a positive level, and the first low voltage ELVSS1 has a negative level. The power supplying unit 350 may be electrically connected to the organic light-emitting panel 100 via switching devices SW1 and SW2. The first high voltage ELVDD1 and the first low voltage ELVSS1 are input to the organic light-emitting panel 100. The power supplying unit 350 may use a DC-to-DC converter as a DC power generator.

When the organic light-emitting panel 100 operates in the normal mode, the power supplying unit 350 supplies the first high voltage ELVDD1 and the first low voltage ELVSS1 to the organic light-emitting panel 100. When the organic light-emitting panel 100 operates in the low power display mode or a standby mode, the power supplying unit 350 cuts the first high voltage ELVDD1 and the first low voltage ELVSS1. The first high voltage ELVDD1 and the first low voltage ELVSS1 are supplied to the organic light-emitting panel 100.

The driving integrated circuit 450 selects a plurality of input voltages according to a display mode of the organic light-emitting panel 100. The driving integrated circuit 450 generates a voltage from combination of the selected input voltages, wherein the voltage is necessary for the organic light-emitting panel 100 in the normal mode or the low power display mode. For example, the driving integrated circuit 450 may receive the panel power voltage VCI, the logic voltage VDDI, and the touch voltage VDD from the power source unit 250. The driving circuit 450 may generate a voltage from the appropriate combination thereof. The generated voltage is for the organic light-emitting panel 100. The driving integrated circuit 450 determines the display mode of the organic light-emitting panel 100. The driving integrated circuit 450 outputs a control signal SW that turns on the switching devices SW1 and SW2 when the organic light-emitting panel 100 is in the normal mode. The driving integrated circuit 450 turns off the switching devices SW1 and SW2 when the organic light-emitting panel 100 is in the low power display mode or the standby mode.

When the organic light-emitting panel 100 is in the normal mode, the driving integrated circuit 450 receives the panel power voltage VCI, and generates a first driving voltage Vdd and a second driving voltage Vss for operating each driver of the organic light-emitting panel 100. The first driving voltage Vdd and the second driving voltage Vss are supplied to the organic light-emitting panel 100.

When the organic light-emitting panel 100 is in the low power display mode, the driving integrated circuit 450 generates the second high voltage ELVDD2 and the second low voltage ELVSS2 by using the panel power voltage VCI and the touch voltage VDD. The second high voltage ELVDD2 has a positive level, and the second low voltage ELVSS2 has a negative level. A voltage difference between the second high voltage ELVDD2 and the second low voltage ELVSS2 is less then a voltage difference between the first high voltage ELVDD1 and the first low voltage ELVSS1. The second high voltage ELVDD2 and the second low voltage ELVSS2 are supplied to the organic light-emitting panel 100. The second high voltage ELVDD2 and the second low voltage ELVSS2 may be generated by combining the panel power voltage VCI and the touch voltage VDD by using a charge pump in the driving integrated circuit 450. Also, the driving integrated circuit 450 generates a third driving voltage Vdd' and a fourth driving voltage Vss' by using the panel power voltage VCI and the touch voltage VDD. The third driving voltage Vdd and the fourth driving voltage Vss may be equivalent to or different from the first driving voltage Vdd and the second driving voltage Vss.

The touch integrated circuit 600 receives the touch voltage VDD from the power source unit 250, and generates a driving signal for operating the touch sensor 650.

The touch sensor 650 receives the driving signal from the touch integrated circuit 600, and detects a contact by a user or an object. The touch sensor 650 may be separately arranged on the organic light-emitting panel 100, or may be embedded in a pixel array.

As described above, when the low voltage such as the panel power voltage VCI is boosted or stepped down to generate the voltage necessary for the organic light-emitting panel 100, power consumption increases. However, in the present embodiment, the driving integrated circuit 450 does not boost or step down only the panel power voltage VCI, but uses all of the panel power voltage VCI, the logic voltage VDDI, and the touch voltage VDD, so that boosted or stepped down voltages may be decreased. Thus, it is possible to generate the low voltage by using minimum power. The low voltage is optimal for the organic light-emitting panel 100 in the low power display mode.

In the low power display mode, it is possible to decrease a power consumed by the driving integrated circuit 450 so as to generate the second high voltage ELVDD2 and the second low voltage ELVSS2.

Figure 7:
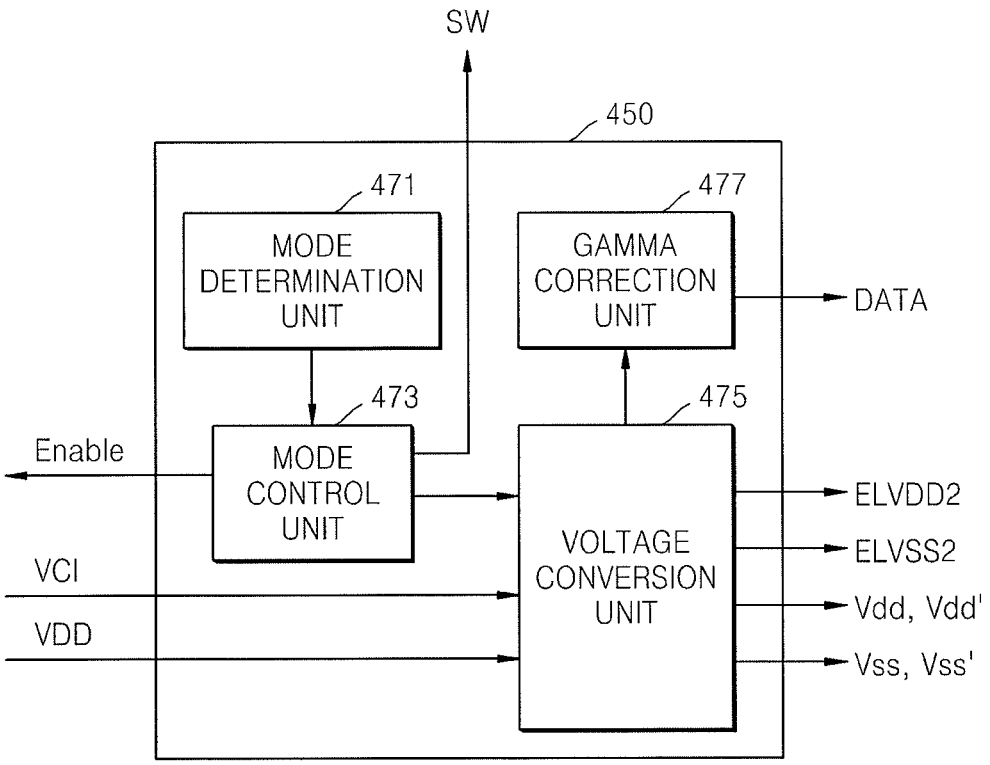
FIG. 7 illustrates a block diagram of a configuration of a driving integrated circuit of FIG. 6 according to an embodiment.

FIG. 7 illustrates a block diagram of a configuration in the driving integrated circuit 450 of FIG. 6 according to an embodiment. Referring to FIG. 7, the driving integrated circuit 450 includes a mode determination unit 471, a mode control unit 473, a voltage conversion unit 475, and a gamma correction unit 477.

The mode determination unit 471 determines a display mode of the organic light-emitting panel 100. The mode determination unit 471 compares a display mode of the organic light-emitting panel 100 at a previous frame with a display mode of the organic light-emitting panel 100 at a current frame. When the display modes are the same, the power supplying unit 350 and the driving integrated circuit 450 operate in the same manner as the previous frame.

The mode control unit 473 controls operations of the power supplying unit 350, the first and second switching devices SW1 and SW2 (refer to FIG. 6), and the voltage conversion unit 475 according to the mode determination unit 471. The mode control unit 473 controls the operation of the power supplying unit 350 by applying an enable signal to the power supplying unit 350. The mode control unit 473 controls the operations of the first and second switching devices SW1 and SW2 by applying a switching signal SW to each of the first and second switching devices SW1 and SW2.

The voltage conversion unit 475 selects a plurality of input voltages according to the display mode, generates a plurality of output voltages by boosting or stepping down the selected voltages or by combining the selected voltages, and outputs the generated output voltages to the gamma correction unit 477 and the organic light-emitting panel 100.

When the organic light-emitting panel 100 operates in the normal mode, the voltage conversion unit 475 generates a first driving voltage Vdd and a second driving voltage Vss by boosting and stepping down a panel power voltage VCI. The voltage conversion unit 475 supplies the first driving voltage Vdd and the second driving voltage Vss to the organic light-emitting panel 100. When the organic light-emitting panel 100 operates in the low power display mode, the voltage conversion unit 475 generates a second high voltage ELVDD2 and a second low voltage ELVSS2, and a third driving voltage Vdd' and a fourth driving voltage Vss' by combining the panel power voltage VCI, a logic voltage VDDI, and a touch voltage VDD. The organic light-emitting panel 100 supplies the second high voltage ELVDD2, the second low voltage ELVSS2, the third driving voltage Vdd', and the fourth driving voltage Vss' to the organic light-emitting panel 100.

The gamma correction unit 477 receives a gamma correction voltage generated by the voltage conversion unit 475, and outputs data DATA. The output data DATA has a corrected gamma value. The output data DATA is supplied to the organic light-emitting panel 100.

Although not illustrated in FIG. 7, the driving integrated circuit 450 may include a timing control unit (not shown). The timing control unit outputs a control signal for controlling each driver of the organic light-emitting panel 100. For example, the timing control unit generates a scan control signal and a data control signal, and applies the scan control signal and the data control signal to a scan driver and a source driver, respectively, of the organic light-emitting panel 100. The scan control signal includes a scan start signal and a plurality of clock signals SCLK. The scan start signal indicates a start of a scanning operation. The data control signal includes a horizontal synchronization start signal STH and a clock signal. The horizontal synchronization start signal STH indicates a transfer of input image data with respect to pixels P in one row.

Figure 8:
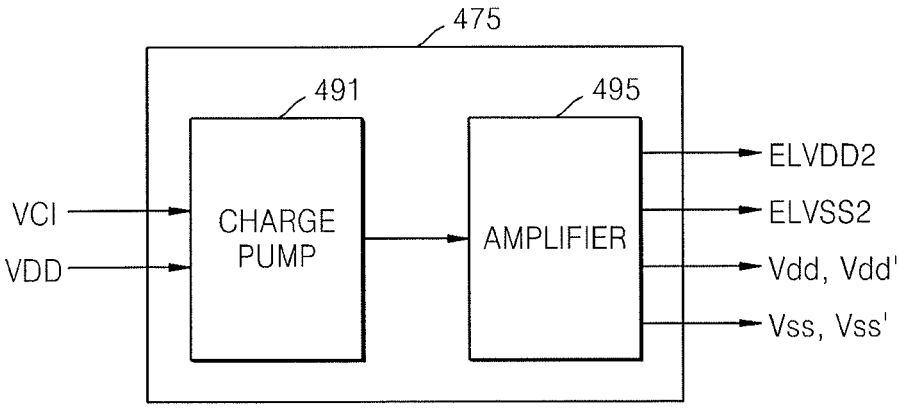
FIG. 8 illustrates a block diagram of a configuration of a voltage conversion unit of FIG. 7 according to an embodiment.

According to an embodiment, FIG. 8 illustrates a block diagram of a configuration in the voltage conversion unit 475 of FIG. 7. Referring to FIG. 8, the voltage conversion unit 475 includes a charge pump 491 and an amplifier 495.

The charge pump 491 boosts an input voltage and then outputs a positive voltage and a negative voltage, which are a multiple of the input voltage. The charge pump 491 uses capacitors in the boosting operation. The input voltage of the charge pump 415 includes a panel power voltage VCI and a touch voltage VDD.

The amplifier 495 amplifies a voltage output from the charge pump 491, and then generates a first driving voltage Vdd and a second driving voltage Vss. The amplifier 495 amplifies a voltage output from the charge pump 491, and then generates a second high voltage ELVDD2 or a second low voltage ELVSS2. The amplifier 495 may separately include an amplifier for generation of a driving voltage, and an amplifier for generation of a power voltage.

Figure 9:
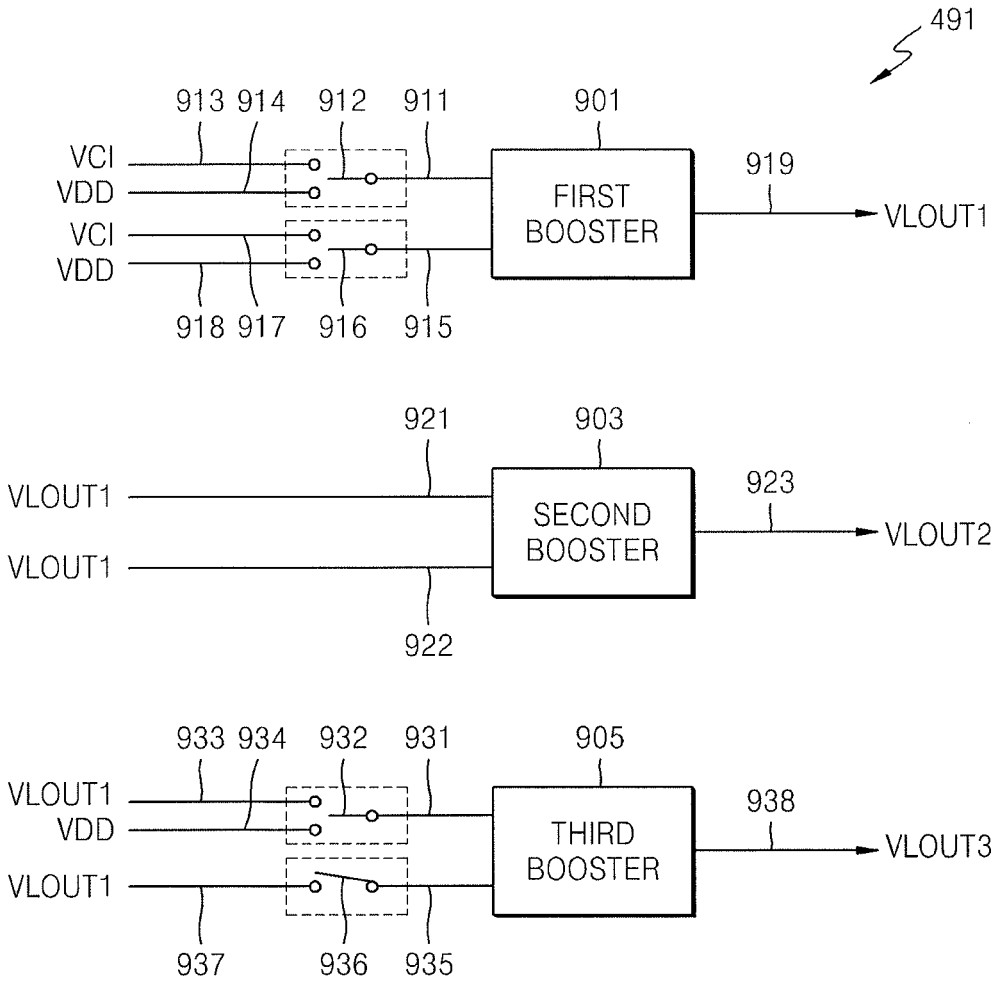
FIG. 9 illustrates a block diagram of configuration in a charge pump of FIG. 8 according to an embodiment.

FIG. 9 illustrates a block diagram of a configuration of the charge pump 491 of FIG. 8 in accordance with an embodiment. Referring to FIG. 9, the charge pump 491 includes a first booster 901, a second booster 903, and a third booster 905. Each of the boosters 901, 903, and 905 selectively receives an input voltage according to a display mode of the organic light-emitting panel 100, and outputs a voltage according to the display mode. The input voltage of each of the boosters 901, 903, and 905 includes a panel power voltage VCI and a touch voltage VDD.

The first booster 901 outputs a first output voltage VLOUT1 by using the panel power voltage VCI and the touch voltage VDD. The first booster 901 receives the panel power voltage VCI or the touch voltage VDD via a first booster input line 911. A switch 912, connected to the first booster input line 911, is selectively connected to a panel power voltage input line 913 or a touch voltage input line 914 according to a display mode of the organic light-emitting panel 100. The first booster 901 receives the panel power voltage VCI or the touch voltage VDD via a second booster input line 915. A switch 916, connected to the second booster input line 915, is selectively connected to a panel power voltage input line 917 or a touch voltage input line 918 according to the display mode of the organic light-emitting panel 100.

When the organic light-emitting panel 100 is in the normal mode, the switch 912 is connected to the panel power voltage input line 913, and the switch 916 is connected to the panel power voltage input line 917. The first booster 901 outputs a first output voltage VLOUT1, via a first output line 919, by using the panel power voltage VCI applied via the first booster input line 911 and the panel power voltage VCI applied via the second booster input line 915. The first output voltage VLOUT1 corresponds to 2×VCI, i.e. double of the panel power voltage VCI. The first output voltage VLOUT1 is amplified by the amplifier 495, and output to the gamma correction unit 477.

When the organic light-emitting panel 100 is in the low power display mode, the switch 912 is connected to the touch voltage input line 914. The switch 916 is connected to the touch voltage input line 918. The first booster 901 outputs a first output voltage VLOUT1 via the first output line 919. The first booster 901 outputs a first output voltage VLOUT1 by using the touch voltage VDD applied via the first booster input line 911 and the touch voltage VDD applied via the second booster input line 915. The first output voltage VLOUT1 corresponds to 2×VDD, i.e. double of the touch voltage VDD. The first output voltage VLOUT1 is amplified by the amplifier 495, and output to the gamma correction unit 477.

The second booster 903 outputs a second output voltage VLOUT2 by using the first output voltage VLOUT1. The second booster 903 receives the first output voltage VLOUT1 via a first booster input line 921 and a second booster input line 922.

When the organic light-emitting panel 100 is in the normal mode, the second booster 903 outputs the second output voltage VLOUT2 via a second output line 923. The second output voltage VLOUT2 corresponds to 4×VCI, i.e. the sum of the first output voltage VLOUT1 (2×VCI) applied via the first booster input line 921 and the first output voltage VLOUT1 (2×VCI) applied via the second booster input line 922. The second output voltage VLOUT2 is amplified by the amplifier 495, and output as a first driving voltage Vdd.

When the organic light-emitting panel 100 is in the low power display mode, the second booster 903 outputs a second output voltage VLOUT2 via the second output line 923. The second output voltage VLOUT2 corresponds to 4×VDD, i.e. the sum of the first output voltage VLOUT1 (2×VDD) applied via the first booster input line 921 and the first output voltage VLOUT1 (2×VDD) applied via the second booster input line 922. The second output voltage VLOUT2 is amplified by the amplifier 495, and output as a second high voltage ELVDD2 or a third driving voltage Vdd'.

The third booster 905 outputs a third output voltage VLOUT3 by using the first output voltage VLOUT1 and the touch voltage VDD. The third booster 905 receives the first output voltage VLOUT1 or the touch voltage VDD via a first booster input line 931. A switch 932, connected to the first booster input line 931, is selectively connected to a first output voltage input line 933 or a touch voltage input line 934 according to a display mode of the organic light-emitting panel 100. The third booster 905 receives the first output voltage VLOUT1 via a second booster input line 935. A switch 936, connected to the second booster input line 935, is selectively connected to a first output voltage input line 937 according to a display mode of the organic light-emitting panel 100.

When the organic light-emitting panel 100 is in the normal mode, the switch 932 is connected to the first output voltage input line 933, and the switch 936 is connected to the first output voltage input line 937. The third booster 905 outputs a third output voltage VLOUT3 via a third output line 938 by using the first output voltage VLOUT1 (2×VCI). The first output voltage VLOUT1 is applied via each of the first booster input line 931 and the second booster input line 935. The third output voltage VLOUT3 corresponds to −4×VCI, i.e. a negative quadruple of the panel power voltage VCI. The third output voltage VLOUT3 is amplified by the amplifier 495, and output as a second driving voltage Vss.

When the organic light-emitting panel 100 is in the low power display mode, the switch 932 is connected to the touch voltage input line 934, and the switch 936 is open. The third booster 905 outputs a third output voltage VLOUT3 via the third output line 938 by using the touch voltage VDD that is applied via the first booster input line 931. The third output voltage VLOUT3 corresponds to −1×VDD, i.e. a negative of the touch voltage VDD. The third output voltage VLOUT3 is amplified by the amplifier 495, and output as a second low voltage ELVSS2 or a fourth driving voltage Vss'.

In the aforementioned embodiments, when the organic light-emitting panel 100 is in the low power display mode, a voltage for the organic light-emitting panel 100 is generated by using the logic voltage VDDI or the touch voltage VDD as the input voltage. Generation of the voltage for the organic light-emitting panel 100 is not limited thereto. The voltage for the organic light-emitting panel 100 in the low power display mode may vary according to a characteristic of a panel, so that the input voltage may be set from combination of the panel power voltage VCI, the logic voltage VDDI, and the touch voltage VDD, according to a low voltage necessary for the organic light-emitting panel 100 in the low power display mode. For example, where the panel power voltage VCI is 3.7V, the logic voltage VDDI is 1.8V, and the touch voltage VDD is 2.8V, if the organic light-emitting panel 100 requires 6.5V, the driving integrated circuit may select the panel power voltage VCI having 3.7V and the touch voltage VDD having 2.8V as input voltages. Compared to a scenario in which 6.5V is generated by additionally boosting the panel power voltage VCI or the logic voltage VDDI, power consumption is reduced. According to the aforementioned embodiments, voltages (e.g., a voltage from a camera module included in a display apparatus) that may be supplied from a power source unit are added to input voltages, so that the low voltage for the organic light-emitting panel 100 may be generated by selectively using the input voltages.

The organic light-emitting display apparatus is described as an example in the aforementioned embodiments, but the display apparatus according to the one or more embodiments of the present invention is not limited thereto and thus may include various types of display apparatuses including the organic light-emitting display apparatus, a liquid crystal display (LCD) device, a field emission display (FED) device, or the like.

According to the one or more embodiments, when the organic light-emitting panel is in the low power display mode, a power voltage for a panel is supplied from the driving integrated circuit, so that power consumption in the power supplying unit may be reduced.

According to the one or more embodiments, when the organic light-emitting panel is in the low power display mode, the power voltage for the panel is generated by using combination of other voltages as well as the panel power voltage, so that power consumption required in voltage generation may be reduced.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A display apparatus, comprising:

a panel to operate in a normal mode and a low power display mode;

a power supplying source that outputs a first high voltage and a first low voltage to the panel in the normal mode, wherein the first high voltage and the first low voltage are first power voltages; and a driving integrated circuit to select at least one input voltage from among a plurality of input voltages according to the display mode of the panel, and output a second high voltage and a second low voltage to the panel in the low power display mode, wherein the second high voltage and the second low voltage are second power voltages generated based on the selected at least one input voltage wherein the driving integrated circuit generates the second power voltages based on a panel power voltage and a logic voltage, wherein the driving integrated circuit comprises:

a mode determination unit that determines the display mode; and a voltage conversion unit that generates a first driving voltage and a second driving voltage based on the panel power voltage in the normal mode, and that generates the second power voltages, a third driving voltage, and a fourth driving voltage based on the panel power voltage and the logic voltage in the low power display mode, wherein the voltage conversion unit comprises:

a charge pump that boosts an input voltage and then outputs a positive voltage and a negative voltage that are a multiple of the input voltage; and an amplifier that amplifies the positive voltage and the negative voltage output from the charge pump, and then generates the first driving voltage, the second driving voltage, the second power voltages, the third driving voltage, and the fourth driving voltage, and wherein the charge pump comprises:

a first booster that outputs a positive first output voltage boosted to a predetermined level by using panel power voltages input via a first input line and a second input line in the normal mode, and that outputs a positive first output voltage boosted to a predetermined level by using the panel power voltage input via the first input line, and a logic voltage input via the second input line in the low power display mode;

a second booster that outputs a positive second output voltage boosted to a predetermined level by using the positive first output voltages input via a first input line and a second input line in the normal mode, and that outputs a positive second output voltage boosted to a predetermined level by using the panel power voltage input via the first input line, and a logic voltage input via the second input line in the low power display mode; and a third booster that outputs a negative third output voltage stepped down to a predetermined level by using the positive first output voltages input via a first input line and a second input line in the normal mode, and that outputs a negative third output voltage stepped down to a predetermined level by using the panel power voltage input via the first input line in the low power display mode.

2. The display apparatus as claimed in claim 1, wherein the power supplying source is to generate the first power voltages based on a panel power voltage which corresponds to one of the input voltages into the driving integrated circuit.

3. The display apparatus as claimed in claim 1, wherein a difference between the second high voltage and the second low voltage is less than a difference between the first high voltage and the first low voltage.

4. The display apparatus as claimed in claim 1, wherein the driving integrated circuit further comprises a gamma corrector that receives a voltage as a gamma correction voltage, wherein the voltage is obtained by amplifying the first output voltage.

5. The display apparatus as claimed in claim 1, further comprising:

a first switching device that is arranged between the power supplying source and the panel, and that cuts the first high voltage; and a second switching device that is arranged between the power supplying source and the panel, and that cuts the first low voltage.

* * * * *